US011168382B2

(12) United States Patent
Asada et al.

(10) Patent No.: US 11,168,382 B2
(45) Date of Patent: Nov. 9, 2021

(54) SLIDING CONTACT MATERIAL AND METHOD FOR PRODUCING SAME

(71) Applicant: TANAKA KIKINZOKU KOGYO K.K., Tokyo (JP)

(72) Inventors: Takao Asada, Oshu (JP); Takumi Niitsuma, Oshu (JP); Terumasa Tsuruta, Tomioka (JP); Masahiro Takahashi, Tomioka (JP); Yuusuke Saito, Tomioka (JP)

(73) Assignee: TANAKA KIKINZOKU KOGYO K.K., Tokyo (JP)

( * ) Notice: Subject to any disclaimer, the term of this patent is extended or adjusted under 35 U.S.C. 154(b) by 0 days.

(21) Appl. No.: 16/067,755

(22) PCT Filed: Jan. 17, 2017

(86) PCT No.: PCT/JP2017/001324
§ 371 (c)(1),
(2) Date: Oct. 4, 2018

(87) PCT Pub. No.: WO2017/130781
PCT Pub. Date: Aug. 3, 2017

(65) Prior Publication Data

US 2019/0345583 A1 Nov. 14, 2019

(30) Foreign Application Priority Data

Jan. 25, 2016 (JP) ..... JP2016-011607

(51) Int. Cl.
*C22C 5/06* (2006.01)
*B22D 7/02* (2006.01)
(Continued)

(52) U.S. Cl.
CPC ..... *C22C 5/06* (2013.01); *B22D 7/02* (2013.01); *B22D 21/02* (2013.01); *B22D 27/04* (2013.01)

(58) Field of Classification Search
None
See application file for complete search history.

(56) References Cited

U.S. PATENT DOCUMENTS 3,929,474 A * 12/1975 Ingersoll ..... A61K 6/844 420/463
2015/0197834 A1* 7/2015 Kumita ..... C22C 30/04 420/464

FOREIGN PATENT DOCUMENTS

JP 49080592 * 8/1974
JP 60-17030 A 1/1985
(Continued)

OTHER PUBLICATIONS

English language machine translation of JP49080592. Generated Nov. 19, 2020. Year: 2020. (Year: 2020).*
(Continued)

*Primary Examiner* — Brian D Walck
(74) *Attorney, Agent, or Firm* — Orrick, Herrington & Sutcliffe LLP; Joseph A. Calvaruso; K. Patrick Herman

(57) ABSTRACT

A sliding contact material that is used for a constituent material, particularly a brush, of a motor. The sliding contact material includes: Pd in an amount of 20.0% by mass or more and 50.0% by mass or less; Ni and/or Co in an amount of 0.6% by mass or more and 3.0% by mass or less in terms of a total concentration; and Ag and inevitable impurities as a balance. Preferably, the sliding contact material further contains an additive element M including at least one of Sn and In, and the total concentration of the additive element M is 0.1% by mass or more and 3.0% by mass or less. When containing the additive element M, the sliding contact mate-
(Continued)

Temperature, °C
Pd
at. %
Sn
L
(Pd)
Pd₂Sn
Pd₃Sn rt
Pd₄Sn rt
Pd₅Sn rt
Pd₁₀Sn rt
Pd₁₀Sn Sn+L
Pd₁₀Sn Sn+L
Pd₁₀Sn rt
Pd₁₀Sn Pd+rt
Pd₁₀Sn Pd+rt
Pd₁₀Sn Pd+ rial has material structures in which composite dispersed particles containing an intermetallic compound of Pd and the additive element M are dispersed in an Ag alloy matrix, and the ratio ($K_{Pd}/K_M$) of the content (% by mass) of Pd and the content (% by mass) of the additive element M in the composite dispersed particles is within a range of 2.4 or more and 3.6 or less.

18 Claims, 8 Drawing Sheets

(51) Int. Cl.
*B22D 21/02* (2006.01)
*B22D 27/04* (2006.01)

(56) References Cited

FOREIGN PATENT DOCUMENTS

| | | | |
|---|---|---|---|
| JP | 60-17031 | A | 1/1985 |
| JP | 60-138876 | A | 7/1985 |
| JP | 60-159138 | A | 8/1985 |
| JP | 3-51263 | B2 | 8/1991 |
| JP | 2000-192169 | A | 7/2000 |
| JP | 2000-192171 | A | 7/2000 |

OTHER PUBLICATIONS

PCT, International Search Report for PCT/JP2017/001324, dated Apr. 18, 2017.

* cited by examiner

COARSE DISPERSED PARTICLES ARE GENERATED IN B13 AND B14

| SPECTRUM | LOCATION | DETECTED ELEMENT (% BY MASS) | | | | |
|---|---|---|---|---|---|---|
| | | Ag | Pd | Ni | Sn | Total |
| I | MATRIX | 69.5 | 30.5 | - | - | 100 |
| II | PdNi ALLOY PHASE | 12.4 | 39.1 | 48.5 | - | 100 |
| III | COMPOSITE DISPERSED PARTICLES | 28.1 | 52.5 | 4.6 | 14.8 | 100 |

$K_{Pd}/K_M = 3.54$

| SPECTRUM | LOCATION | DETECTED ELEMENT (% BY MASS) | | | | |
|---|---|---|---|---|---|---|
| | | Ag | Pd | Ni | In | Total |
| I | MATRIX | 70.0 | 30.0 | - | - | 100 |
| II | PdNi ALLOY PHASE | 30.4 | 23.9 | 45.7 | - | 100 |
| III | COMPOSITE DISPERSED PARTICLES | 30.9 | 51.6 | 1.8 | 15.7 | 100 |

$K_{Pd}/K_M = 3.28$ (a) CUP ARMATURE TYPE (b) DISK ARMATURE TYPE

SLIDING CONTACT MATERIAL AND METHOD FOR PRODUCING SAME

TECHNICAL FIELD

The present invention relates to a sliding contact material formed of an Ag alloy. The present invention relates particularly to a sliding contact material that can be suitably used for brushes of motors which may be placed under a high load due to an increase in rotation speed or the like.

BACKGROUND ART

Motors are devices that are used in many applications including various kinds of household electric appliances, and have been required to have a further reduced size and increased power in recent years. FIG. 7 is a view showing a configuration of a micromotor as one aspect of a small motor. In addition, FIG. 8 is a view illustrating a structure of a coreless motor similarly as one aspect of a small motor. A reduction in size and an increase in power of motors increase the motor rotation speed, and log-life motors having durability that makes it possible to satisfy this requirement are desired.

Examples of the method for improving the life of a motor include adjustment of materials of constituent members in the first place. In particular, a brush as a main constituent member is a member that constantly slides on a commutator, and breakage of the brush due to wear causes stopping of a motor. Thus, as a material for brushes, one having excellent wear resistance has been heretofore required. Here, as conventional sliding contact materials for motor brushes, alloys of Ag and Pd ($AgPd_{30}$ alloy, AgPd50 alloy and the like) are known.

AgPd alloys have been heretofore known as sliding contact materials for motor brushes, but there is a limit on improvement of the wear resistance of the AgPd alloys. This is because the wear resistance of the AgPd alloy can be improved by increasing the content of Pd, but when Pd is added in an amount of more than 50% by mass, an organic gas at a contact surface reacts under the catalytic action of Pd during sliding, so that a brown powder is generated, leading to destabilization of contact resistance. Thus, the AgPd alloy is difficult to use for motors which will be placed under a high load in future.

As a method for improving the wear resistance of an AgPd alloy-based sliding contact material for motor brushes, a method is known in which as an additive element, Cu is formed into an alloy. A material, the wear resistance of which is further improved by adding a further additive element to an AgPdCu alloy (Patent Documents 1 and 2). Such conventional sliding contact materials for motor brushes have gained a certain level of recognition with regard to wear resistance.

RELATED ART DOCUMENT

Patent Documents

Patent Document 1: JP 2000-192169 A
Patent Document 2: JP 2000-192171 A

SUMMARY OF THE INVENTION

Problems to be Solved by the Invention

However, it is pointed out that a sliding contact material formed of an AgPdCu alloy has the problem that heat during sliding oxidizes Cu, leading to destabilization of the contact resistance of the material. In addition, it is questioned whether such a sliding contact material can be satisfactorily used for motors which will be required to have an increased power and rotation speed in future.

Further, with regard to enhancement of performance of motors, studies are being conducted on material improvement and wear resistance improvement for not only a constituent material of a brush but also a commutator as a member that is paired up with the brush. Thus, it is preferable to give consideration to the tendency of improvement of such an opposite material in development of a constituent material of the brush.

The present invention has been made in view of the above-mentioned situations, and an object of the present invention is to provide a sliding contact material for motor brushes, which is superior in wear resistance to the conventional art.

Means for Solving the Problems

The present invention for solving the above-described problems provides a sliding contact material including: Pd in an amount of 20.0% by mass or more and 50.0% by mass or less; Ni and/or Co in an amount of 0.6% by mass or more and 3.0% by mass or less in terms of a total concentration; and Ag and inevitable impurities as a balance.

Hereinafter, the present invention will be described in detail. In the sliding contact material according to the present invention, wear resistance is improved by adding Ni and/or Co to an AgPd alloy. A mechanism for the improvement of wear resistance is based on an effect of increasing the strength on the basis of micronization of crystal grains of an AgPd alloy phase as a matrix by adding Ni and Co. In the present invention, the wear resistance of the AgPd alloy is improved without adding Cu, and there is provided a contact material which eliminates the necessity of worrying about destabilization of contact resistance due to oxidation of Cu.

First, metal elements that form the sliding contact material according to the present invention will be described. First, the Pd concentration is 20.0% by mass or more and 50.0% by mass or less. In the material according to the present invention, Pd is an element that improved wear resistance, and cannot attain sufficient wear resistance when the concentration of Pd is less than 20.0% by mass. In addition, when the Pd concentration is more than 50.0% by mass, contact resistance may be destabilized by generation of a brown powder during sliding.

In the present invention, addition of Ni and/or Co to the AgPd alloy to micronize crystal grains of the alloy matrix, leading to improvement of material strength and wear resistance. The concentration of Ni and Co added is 0.6% by mass or more and 3.0% by mass or less in total. When the concentration of Ni and Co is less than 0.6% by mass, the above-mentioned effect cannot be expected, and when the concentration of Ni and Co is more than 3.0% by mass, the material reinforcement effect is low. Any one or both of Ni and Co may be added. As described above, the concentration of Ni and Co means the total concentration of these elements, and therefore when both Ni and Co are added, the concentration of Ni and Co is 3.0% by mass or less in total.

The above-described sliding contact material including an AgPd (Ni, Co) alloy can exhibit higher wear resistance in comparison with conventional AgPd alloys due to addition of Ni and Co. When an additive element M including at least one of Sn and In is added, the sliding contact material including an AgPd (Ni, Co) alloy exhibits still higher wear resistance. A mechanism for the improvement of wear resistance by the additive element M is based on a dispersion reinforcement effect by composite dispersed particles containing an intermetallic compound of Pd and the additive element M.

Here, each of Sn and In is a metal element capable of forming an intermetallic compound with Pd, and may form a plurality of kinds of intermetallic compounds rather than one kind of intermetallic compound. For example, when attention is given to an intermetallic compound of Sn and Pd, a state diagram of a Pd—Sn system in FIG. 1 shows that in this system, a plurality of kinds of intermetallic compounds having different composition ratios of Sn and Pd may be formed. The present inventors consider that when Sn is added to the AgPd (Ni, Co) alloy, the intermetallic compound having a material reinforcement effect is $Pd_3Sn$. It is considered that intermetallic compounds having other composition ratios do not contribute to material reinforcement.

Similarly, when In is added, a specific intermetallic compound can contribute to material reinforcement. It is considered that in the case of In, a plurality of kinds of intermetallic compounds may be formed, and the intermetallic compound having an effective reinforcement effect is $Pd_3In$.

In addition, in the present invention, simultaneous addition of Sn and In is acceptable. Sn and In may show similar behaviors in the alloy system in the present invention. Sn and In may be bonded to Pd to form an intermetallic compound ($Pd_3$ (Sn, In)), leading to exhibition of a reinforcement effect.

It is evident that in composite dispersed particles including an effective intermetallic compound, the ratio ($K_{Pd}/K_M$) of the content (% by mass) of Pd and the content (% by mass) of the additive element M in the particles is within a certain range. The ratio ($K_{Pd}/K_M$) is 2.4 or more and 3.6 or less. In the sliding contact material according to the present invention, the ratio $K_{Pd}/K_M$ of almost all (90 to 100% in terms of the number of particles) of existing dispersed particles including both Pd and the additive element M is 2.4 or more and 3.6 or less. In calculation of the ratio $K_{Pd}/K_M$ in the composite dispersed particle, the content of the additive element M is calculated on the basis of the total of the Sn content (% by mass) and the In content (% by mass), and the ratio $K_{Pd}/K_M$ is within a range of 2.4 or more and 3.6 or less.

As a configuration of the composite dispersed particle, the composite dispersed particle essentially contains an intermetallic compound including Pd and the additive element M, but is not required to be composed of only the intermetallic compound. The composite dispersed particle may contain, together with the intermetallic compound, Ag, Ni and Co that forms a matrix. While containing these metal elements, the composite dispersed particle may be characterized by the contents of Pd and the additive element M, where the ratio $K_{Pd}/K_M$ is 2.4 or more and 3.6 or less.

The average particle size of the composite dispersed particles is preferably 0.1 μm or more and 1.0 μm or less. This is because in improvement of wear resistance by the dispersion reinforcement effect, coarsened dispersed particles have a poor reinforcement effect.

The added amount of the additive element M (Sn, In) is 0.1% by mass or more and 3.0% by mass or less in terms of a total concentration. This is because the configuration of the composite dispersed particles is made appropriate, and coarsening of the dispersed particles and the consequent reduction in strength are prevented. Preferably, the content of Sn is 0.5% by mass or more and 1.0% by mass or less. The content of In is preferably 1.0% by mass or more and 2.0% by mass or less. When both Sn and In are added, the total content of these elements is preferably 0.5% by mass or more and 3.0% by mass or less.

In the sliding contact material with Sn and In added to an AgPd (Ni, Co) alloy, the material is reinforced by the effect of composite dispersed particles ($Pd_3Sn$, $Pd_3In$) as described above. However, in the present invention, existence of phases (precipitates) other than these specific intermetallic compounds is not rejected. Such phases do not contribute to material reinforcement, but do not act as hindrance factors, and therefore existence thereof is acceptable.

Examples of the dispersed particle phase other than composite dispersed particles include alloy particles of Pd and Ni or Co (PdNi alloy particles or PdCo alloy particles). PdNi alloy particles or PdCo alloy particles form a spherical or acicular dispersed phase, which is an alloy phase in which the concentration ratio of Ni or Co to Pd (Ni/Pd or Co/Pd) is within a range of 0.67 to 1.5. The alloy phase does not affect the strength of the alloy as a whole.

The matrix (parent phase) of the sliding contact material according to the present invention includes an AgPd alloy irrespective of presence/absence of Sn and In. However, depending on the contents of Ni and Co in the contact material as a whole, the AgPd alloy contains Ni and Co in a very small amount of 0.5% by mass or less.

The sliding contact material according to the present invention can be expected to have higher wear resistance and a longer life in comparison with conventional AgPd alloys as materials for motor brushes. The sliding contact material according to the present invention is considered to be applied to motor brushes, and it is preferable to give consideration to performance as a contact structure formed by a combination of the sliding contact material with constituent materials of a commutator that is a partner material of the brush.

Here, examples of the previously known constituent material of a commutator of a motor include AgCu alloys and AgCuNi alloys which are AgCu alloy-based materials. An AgCuNi alloy containing Cu in an amount of 4.0% by mass or more and 10.0% by mass or less, Ni in an amount of 0.1% by mass or more and 1.0% by mass or less and Ag as a balance, as a specific composition, is particularly well known. In addition, an AgCuNi-based alloy obtained by adding at least one of Zn in an amount of 0.1% by mass or more and 2.0% by mass or less, Mg in an amount of 0.1% by mass or more and 2.0% by mass or less and Pd in an amount of 0.1% by mass or more and 2.0% by mass or less to the AgCuNi alloy is also applied. The constituent materials of conventional commutators have a Vickers hardness Hv of 120 or more and 150 or less.

On the other hand, in recent years, a material in which at least one of rare earth metals (Sm and La) and Zr in an amount of 0.1% by mass or more and 0.8% by mass or less is added to an AgCu alloy or AgCuNi-based alloy as listed above, and an intermetallic compound is dispersed has been developed as an improved material of a commutator, in which wear resistance is improved. The improved constituent material of a commutator has a hardness higher than that of the conventional material, and exhibits a Vickers hardness $H_V$ of 140 or more and 180 or less.

The sliding contact material according to the present invention includes an AgPd (Ni, Co) alloy, or includes an alloy obtained by further adding at least one of Sn and In to the AgPd (Ni, Co) alloy. Basically, in comparison with a case where an AgPd alloy in the conventional art is applied, the present invention can attain higher wear resistance and a longer life in a contact structure with the contact material combined with the conventional or improved material for commutators.

However, the contact material including an AgPd (Ni, Co) alloy exhibits favorable durability in a combination with a conventional commutator material such as an AgCu alloy or an AgCuNi-based alloy as a preferred combination.

On the other hand, the material with Sn or In further added to the AgPd (Ni, Co) alloy exhibits high durability with respect to not only a conventional commutator material such as an AgCu alloy or an AgCuNi-based alloy but also the improved commutator material containing a rare earth element or Zr.

Next, a method for manufacturing the sliding contact material according to the present invention will be described. Basically, the sliding contact material according to the present invention can be produced by a melting and casting method. The melting and casting step is a step of preparing a molten Ag alloy adjusted to a predetermined composition, and cooling and solidifying the molten Ag alloy having a casting temperature. The molten Ag alloy has a composition of an alloy to be produced, the alloy composition being as described above. For the AgPd (Ni, Co) alloy, a normal melting and casting is often applicable.

However, for the alloy material with at least one of Sn and In added to an AgPd (Ni, Co) alloy, it is necessary that composite dispersed particles having a predetermined composition (ratio ($K_{Pd}/K_M$) of the content of Ni and the content of the additive element M) be dispersed. For precipitating an intermetallic compound having a specified composition as described above, control of the casting temperature (molten metal temperature) and adjustment of the cooling rate are required. The above-described effective intermetallic compounds each have a high melting point and high solidus temperature. For an alloy for which precipitation of such an intermetallic compound having a high melting point is required, it is necessary to control both the casting temperature and the cooling rate.

Specifically, the casting temperature is set to a temperature higher by 100° C. or more than the liquidus temperature of an AgPd binary alloy having a Pd concentration equal to the Pd concentration of an Ag alloy to be produced. As a method for setting a casting temperature, a state diagram of an AgPd binary alloy as in FIG. 2 is provided, a liquidus temperature of the AgPd alloy having a Pd concentration equal to that of an Ag alloy to be produced is read from the state diagram, and a temperature higher by 100° C. or more than the liquidus temperature is defined as the casting temperature. The alloy material according to the present invention includes a large number of metal elements: Ag, Pd, Ni, Co, Sn an In, and the state diagram of the AgPd binary alloy is used for easily and conveniently setting a casting temperature. The reason why the casting temperature is higher by 100° C. or more than the liquidus temperature of the AgPd binary alloy is that at a temperature lower than this temperature, an intended intermetallic compound is not generated. The upper limit of the casting temperature is preferably a temperature higher by 200° C. or less than the liquidus temperature from the viewpoint of practical energy cost, apparatus maintenance and so on. The molten metal may reach this casting temperature before cooling, and is not required to be held at the casting temperature for a long time, but the molten metal is preferably cooled after being held at the casting temperature for about 5 to 10 minutes.

Further, in production of the alloy material according to the present invention, setting a cooling rate in the casting step is also important. It is necessary to increase the cooling rate for ensuring that the intermetallic compound that forms composite dispersed particles in the present invention has a high melting point. When the cooling rate is excessively low, an unfavorable intermetallic compound having a low melting point may be precipitated. For this reason, in the present invention, the cooling rate during solidification is 100° C./min or more. The upper limit of the cooling rate is preferably 3000° C./min or less.

Advantageous Effects of the Invention

As described above, the sliding contact material according to the present invention can exhibit wear resistance higher than that of a conventional AgPd alloy. The present invention is useful as a material for brushes of motors which have a reduced size and increased rotation speed.

DESCRIPTION OF EMBODIMENTS

First embodiment: Hereinafter, an embodiment of the present invention will be described. In this embodiment, a sliding contact material including an AgPd (Ni, Co) alloy was produced, and the properties of the sliding contact material were evaluated.

For production of a test material, high-purity raw materials of metal elements were mixed so as to have a predetermined composition, the mixture was melted at a high frequency to obtain a molten Ag alloy, and the molten Ag alloy was cast at 1300° C., and then rapidly cooled to produce an alloy ingot. The cooling rate was 100° C./min. After casting of the alloy, the alloy was rolled, annealed at 600° C., then rolled again, and cut to obtain a test piece (with a length of 45 mm, a width of 4 mm and a thickness of 1 mm).

In this embodiment, sliding contact materials of various kinds of compositions were produced through the above-mentioned steps for test materials A1 to A5 in Table 1 below. In addition, for comparison with the conventional art, an AgPd alloy free from Ni and Co was produced (A6).

Figure 1:
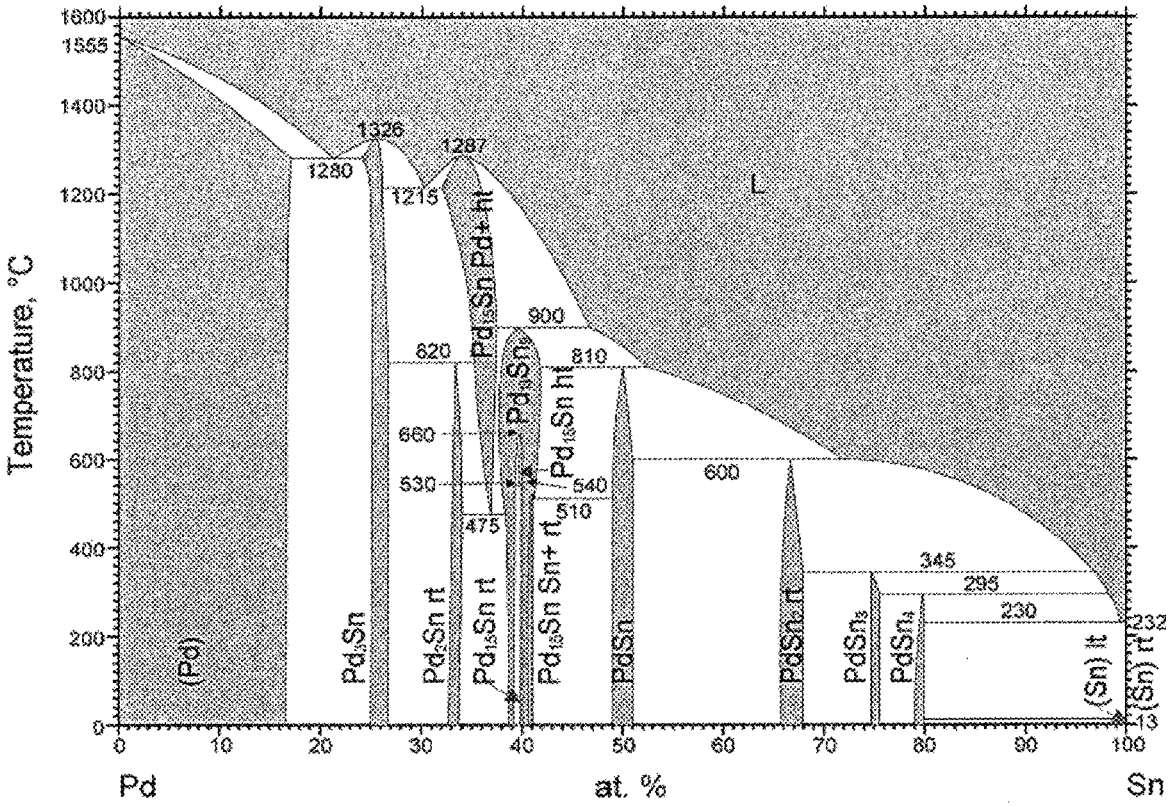
FIG. 1 is a Pd—Sn system state diagram for illustrating an intermetallic compound that is generated in the present invention.
Figure 2:
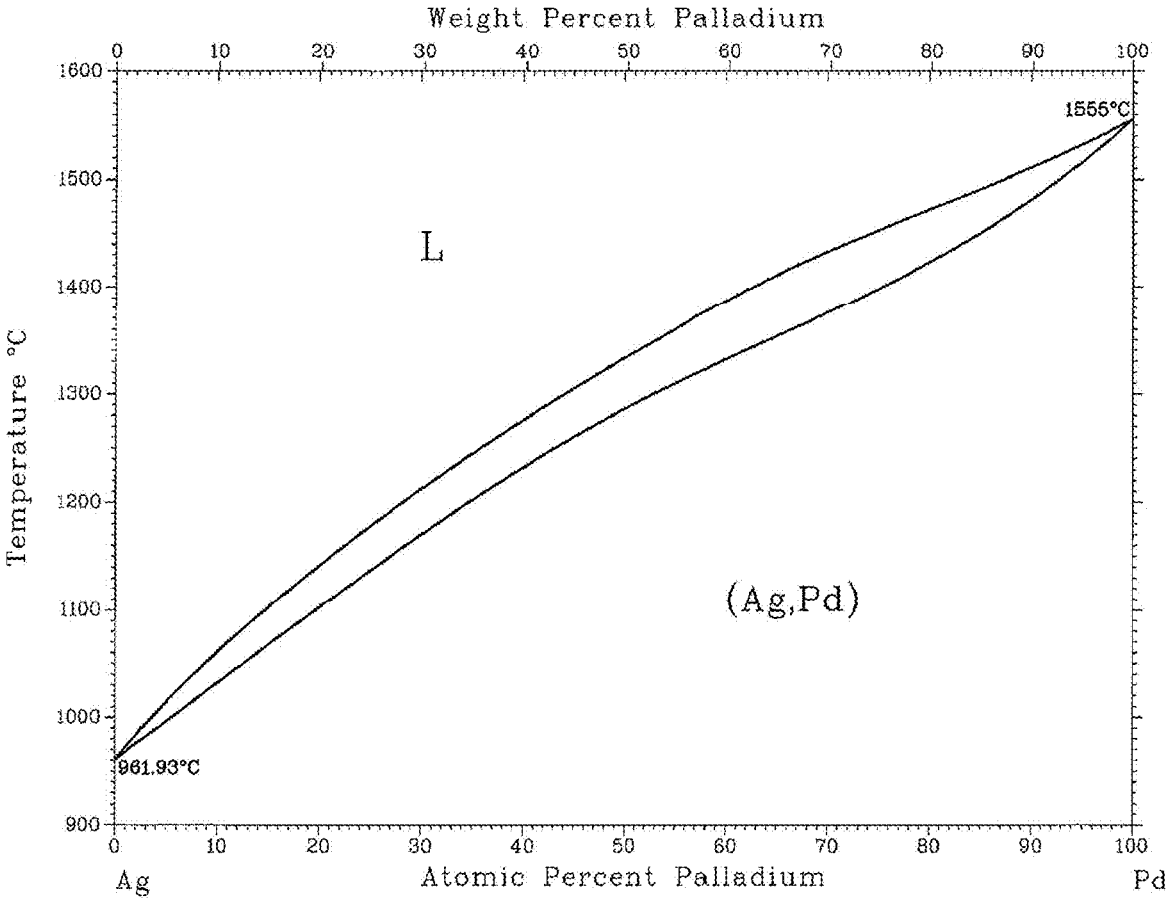
FIG. 2 is a state diagram of an Ag—Pd binary alloy.
Figure 3:
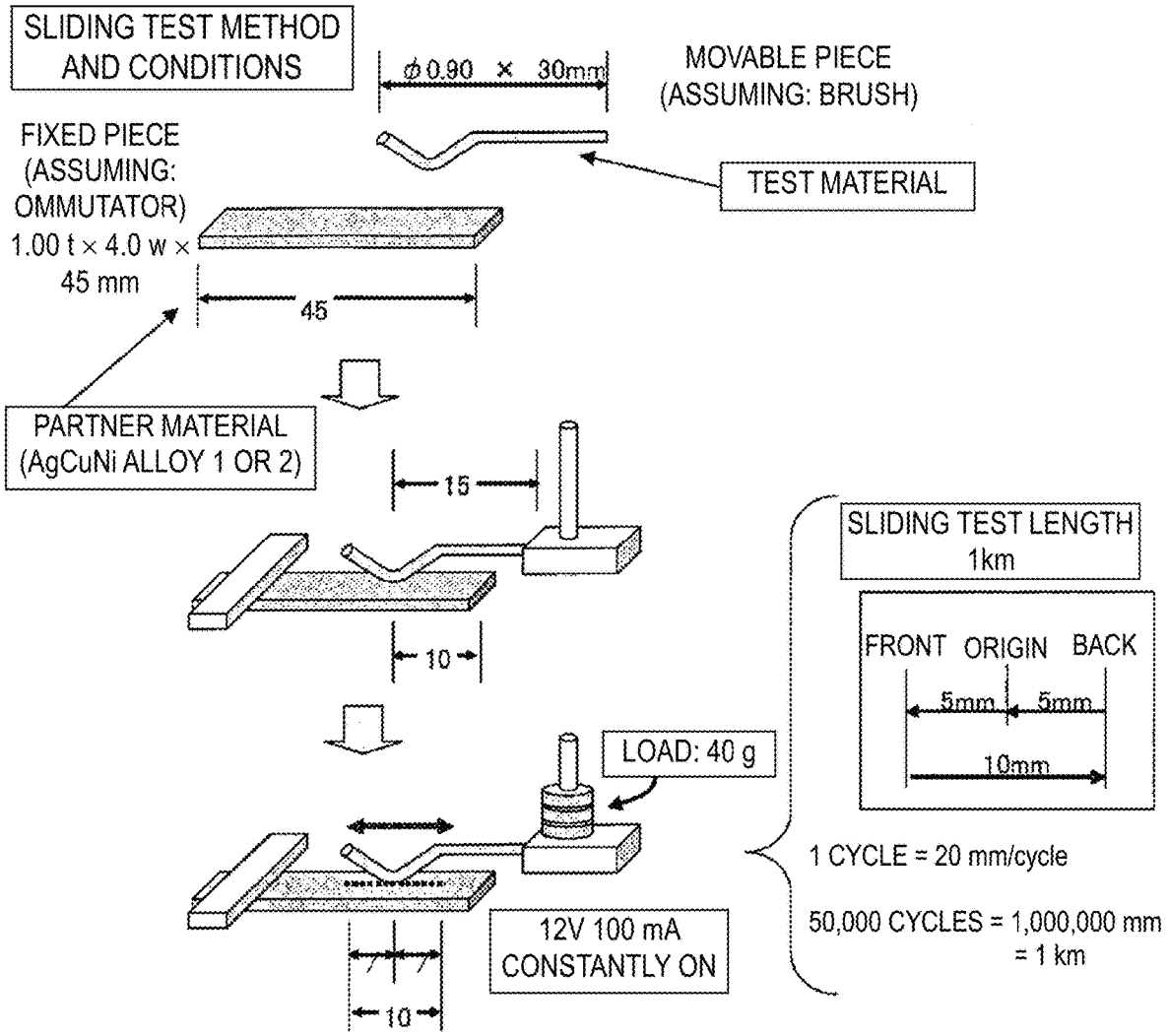
FIG. 3 illustrates a test method for a sliding test conducted in a first embodiment.

Next, a sliding test for evaluation of wear resistance was conducted for each test piece. FIG. 3 schematically illustrates a sliding test method, and in this test, the test piece was processed into a movable contact assuming each test material brush, and the movable contact was slid on a fixed contact assuming a commutator. Here, the movable contact was slid by 50000 cycles (total sliding length: 1 km) with one cycle including moving the movable contact forward by 5 mm and backward by 5 mm from the starting point (over a distance of 10 mm) (total 20 mm) while a load of 40 g was applied with the movable contact constantly fed with electricity at 12 V and 100 mA. After this test, the wear depth (pmt) of a sliding portion of the movable contact was measured.

In this sliding test, two kinds of materials for fixed contacts were used. The two kinds of fixed contact materials used include an AgCuNi alloy (92.5% by mass of Ag/6% by mass of Cu/1% by mass of Zn/0.5% by mass of Ni: hereinafter, referred to as "AgCuNi-1") which is a conventional contact material for brushes; and an alloy with a rare earth metal (Sm) added to an AgCuNi-based alloy (89.6% by mass of Ag/8% by mass of Cu/1% by mass of Zn/1% by mass of Ni/0.4% by mass of Sm: hereinafter, referred to as "AgCuNi-2") which is an improved contact material for brushes.

In evaluation in the sliding test, the measured values of wear depth of the AgPd alloy (A6) free from Ni and Co in the conventional art, with respect to two kinds of partner materials (AgCuNi-1 and AgCuNi-2) were set to references, and wear amounts equal to about 75% of these measured values (wear depth with respect to AgCuNi-1: 2500 $\mu m^2$ and wear depth with respect to AgCuNi-2: 3500 $\mu m^2$) were set to standard values. For each test material, it was determined that the test material was "acceptable" when the wear amount was smaller than the standard value. Results of wear tests for test materials produced in this embodiment are shown in Table 1.

TABLE 1

| | Composition (% by mass) | | | | | | | Wear area (μm2) | | | |
|---|---|---|---|---|---|---|---|---|---|---|---|
| | | | | | Additive element M | | | Partner material | | | |
| No. | Ag | Pd | Ni | Co | Sn | In | Sn + In | AgCuNi-1 | AgCuNi-2 | Evaluation*1 | Remarks |
| A1 | Balance | 30 | 1.0 | — | — | — | — | 1395 | 3954 | ○ | |
| A2 | | | 2.0 | | | | | 1944 | 4070 | ○ | |
| A3 | | | 4.0 | | | | | 2834 | 4851 | x | Excessive amount of Ni |
| A4 | | | — | 1.0 | | | | 2396 | 4036 | ○ | |
| A5 | | | 1.0 | 1.0 | | | | 2232 | 4010 | ○ | |
| A6 | | | — | — | — | — | — | 3188 | 5052 | x | Conventional art |

*1⊙ . . . Acceptable for both of two kinds of partner materials ○ . . . Acceptable for one of two kinds of partner materials
x . . . Unacceptable for both of two kinds of partner materials First, it is confirmed from table 1 that wear resistance can be improved by adding Ni and/or Co to the AgPd alloy (sample A6) which is a conventional sliding contact material for brushes. However, it is apparent that when Ni is added in an excessively amount of 4%, the effect is reduced with the wear area being close to that when Ni is not added (sample A3).

Second embodiment: In this embodiment, various kinds of sliding contact materials each including an Ag alloy with Sn and In further added to an AgPd (Ni, Co) alloy were produced, and the properties of the sliding contact materials were evaluated.

Test materials were produced basically in the same manner as in the first embodiment. High-purity raw materials of metal elements were mixed to obtain a molten Ag alloy, the molten Ag alloy was heated to a temperature higher by 100° C. or more than the liquidus temperature in the AgPd binary state diagram while the molten metal temperature was measured, and the molten Ag alloy was then rapidly cooled to produce an alloy ingot. The casting temperature is 1350° C. for the alloy with 30% by mass of Pd, and 1450° C. for the alloy with 40% by mass of Pd. The cooling rate was 100° C./min for both the alloys. After casting of the alloy, the alloy was rolled, annealed, and rolled again to obtain a test piece having the same size as in the first embodiment (with a length of 45 mm, a width of 4 mm and a thickness of 1 mm).

In this embodiment, sliding contact materials of various kinds of compositions were produced through the above-mentioned production steps for test pieces B1 to B12 in Table 2 below. Further, in this embodiment, influences of alloy production conditions are examined. Here, an alloy (B13) obtained by setting the casting temperature to a temperature (1250° C.) higher by about 50° C. than the liquidus temperature in the AgPd binary state diagram, and rapidly decreasing the temperature from the casting temperature, and an alloy (B14) obtained by setting the molten metal temperature to a temperature (1350° C.) higher by 100° C. than the liquidus temperature in the AgPd binary state diagram, and decreasing the cooling rate to less than 100° C./min in slow cooling (furnace cooling) were also produced.

In this embodiment, structure observation was first performed with a SEM to examine whether composite dispersed particles were precipitated for each prepared test material. 20 composite dispersed particles were randomly selected, the dispersed particles were qualitatively analyzed by EDX to measure the Pd content and the M content in the dispersed particles, and the ratio of the contents of these elements ($K_{Pd}/K_M$) was calculated. In addition, the average particle size of the dispersed particles was measured. For the average particle size, the major diameter (L1) and the minor diameter (L2) of a particle was measured on the basis of a SEM image of the dispersed particle at a high magnification (20000 times), the arithmetic average ((L1+L2)/2) of these diameters was calculated, and this value was defined as the particle size D of the dispersed particle. The particle sizes (Dn (n=1 to 20)) of the 20 dispersed particles were measured, and the average value of these particle sizes was defined as the average particle size of dispersed particles.

Figure 4:
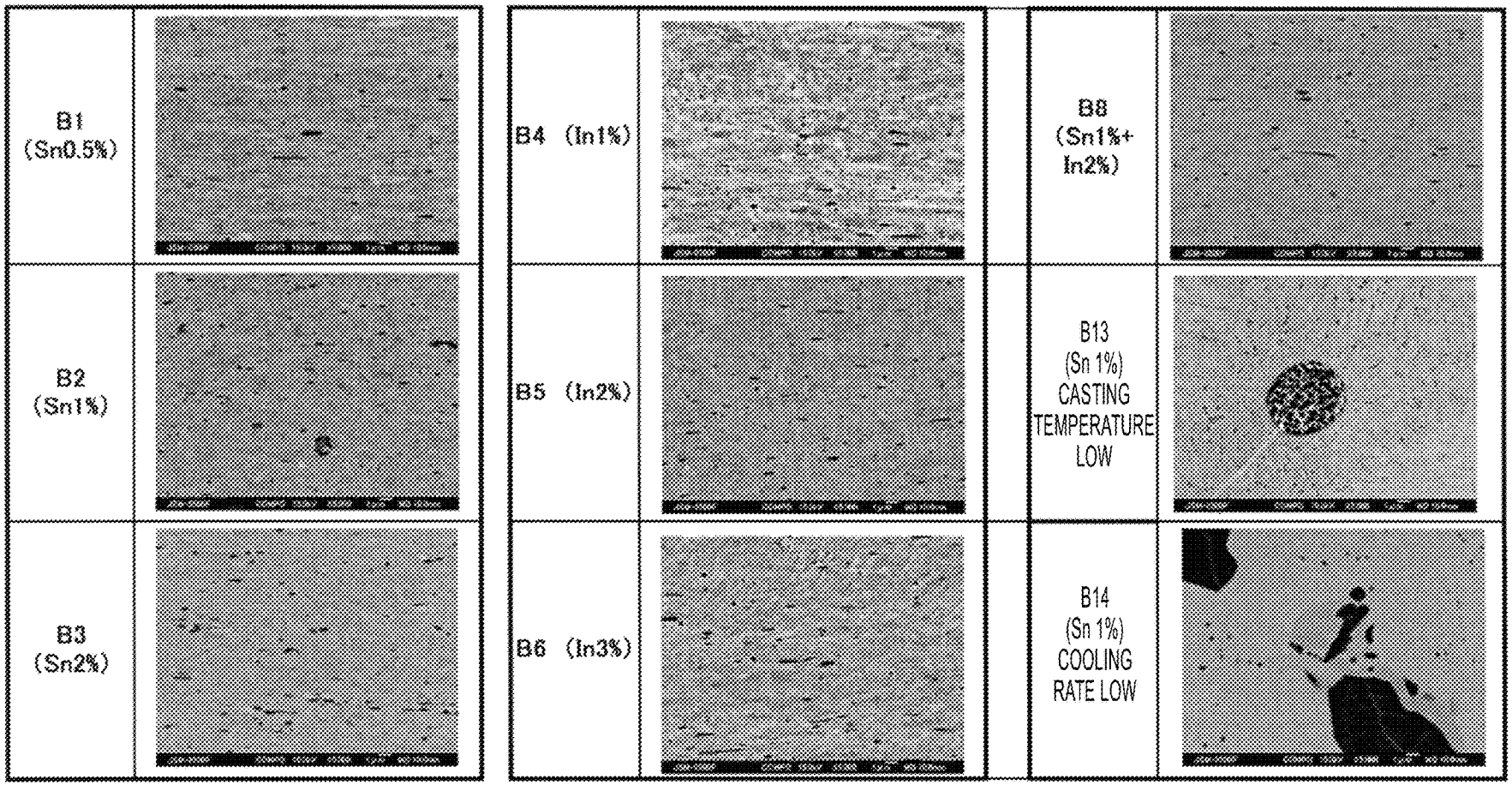
FIG. 4 shows results of structure observation by a SEM for a contact material produced in a second embodiment.
Figure 5:
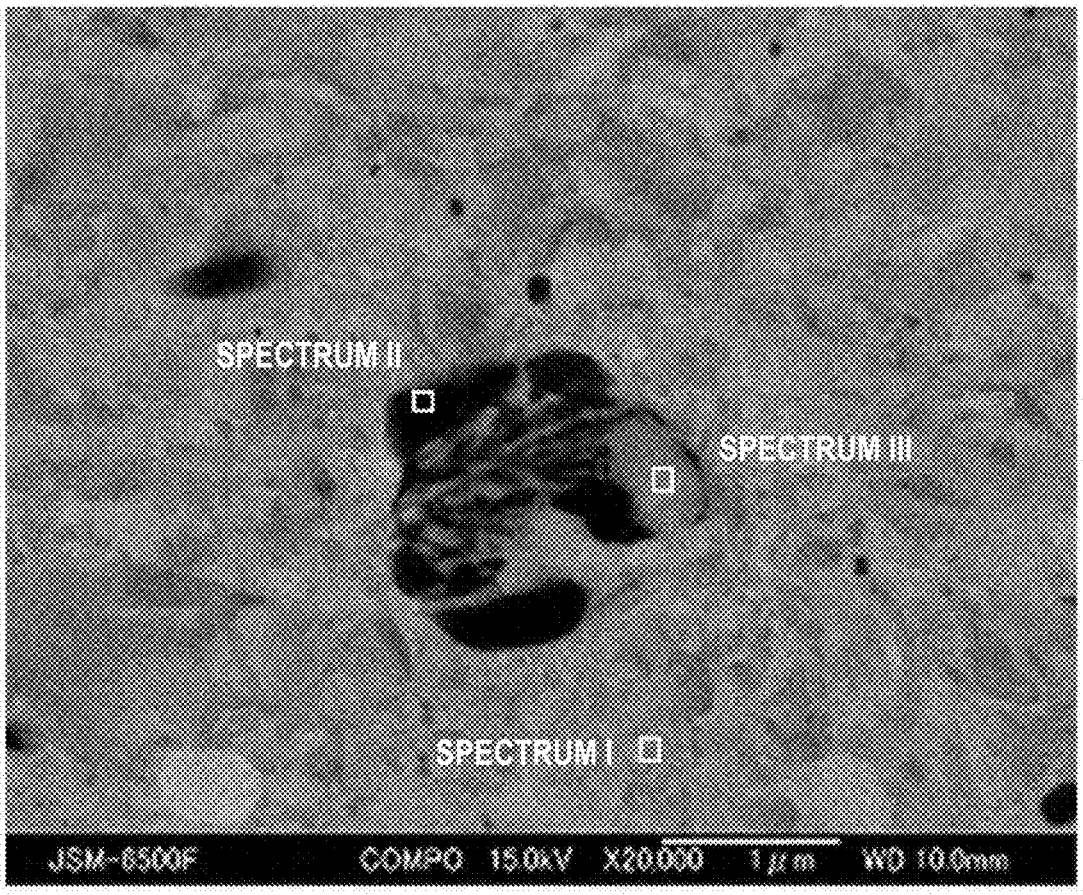
FIG. 5 shows an enlarged picture illustrating analysis points in sample B2 (1% of Ni+1% of Sn), and EDX analysis results in the second embodiment.
Figure 6:
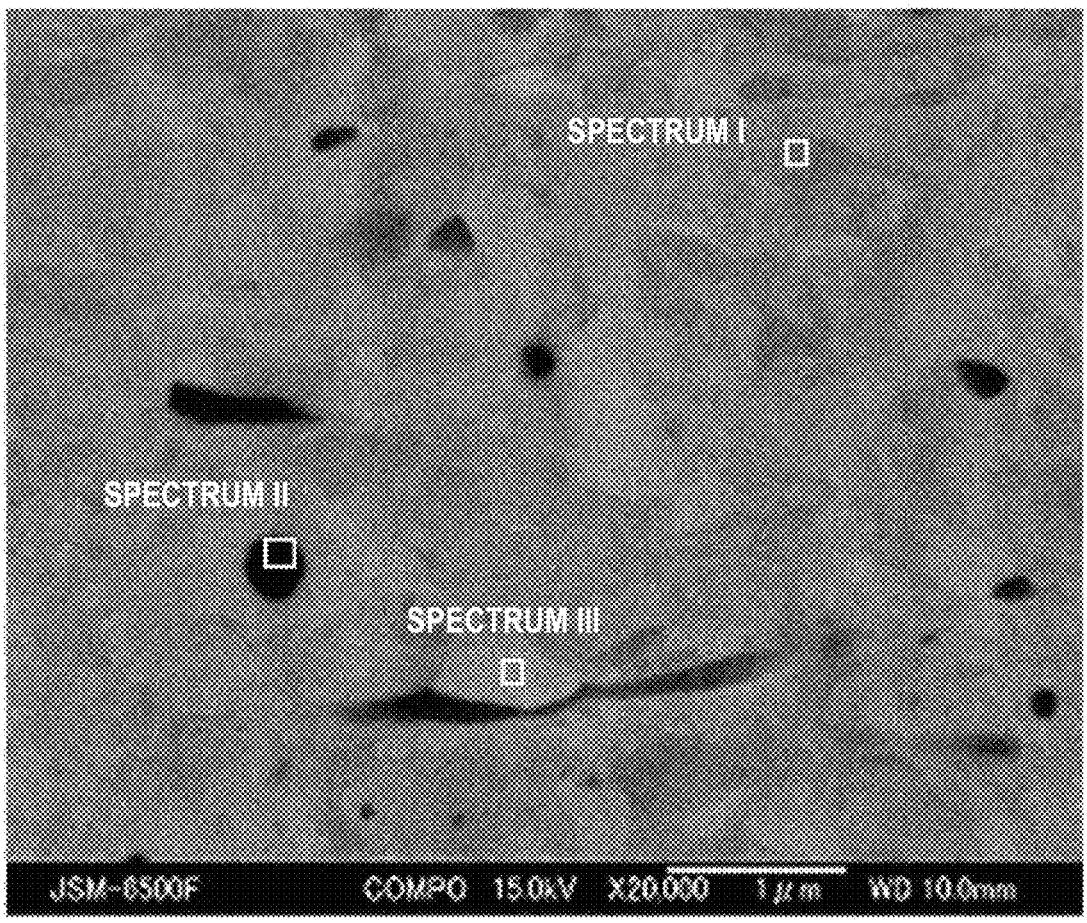
FIG. 6 shows an enlarged picture illustrating analysis points in sample B5 (1% of Ni+2% of In), and EDX analysis results in the second embodiment.
Figure 7:
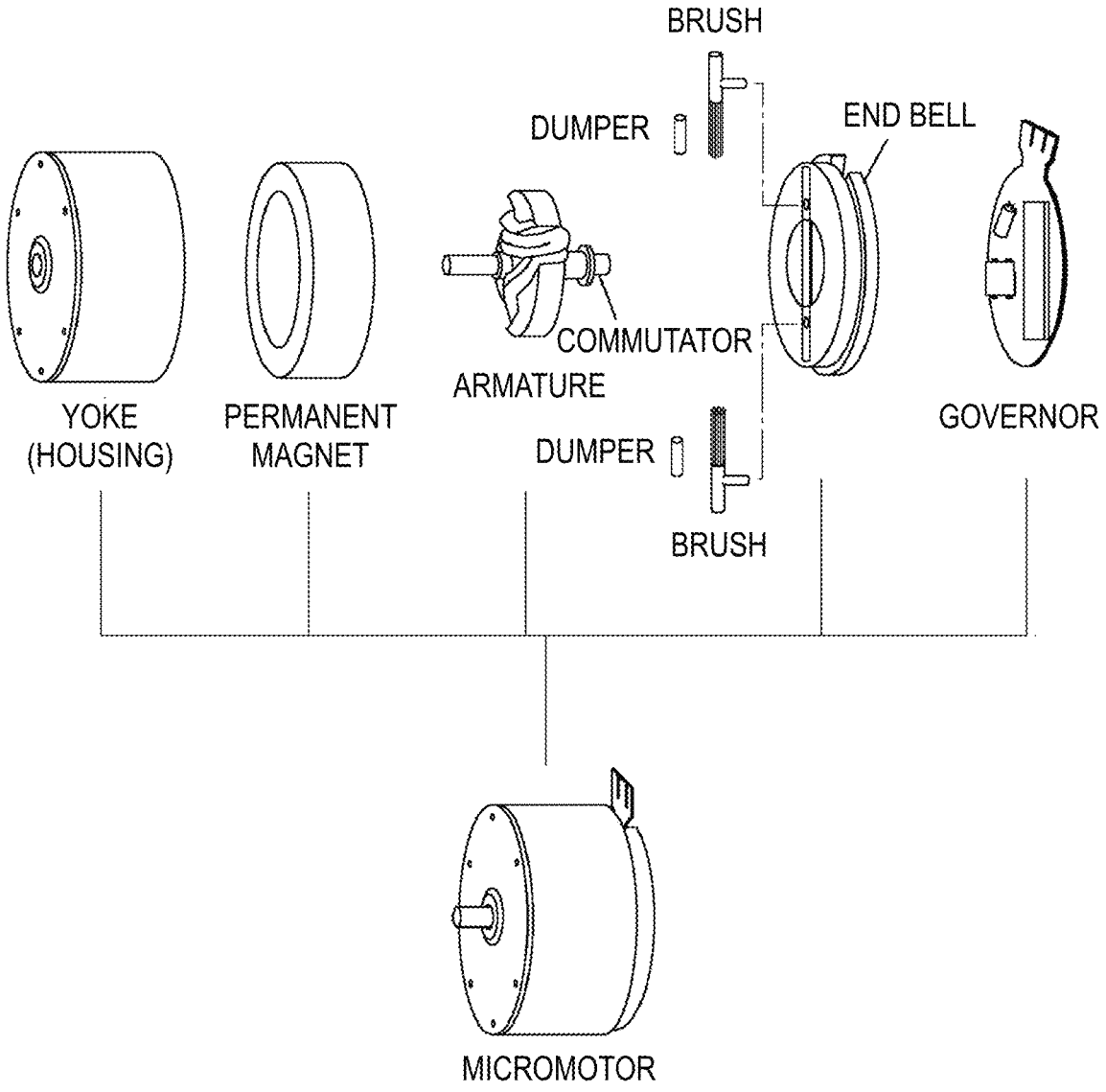
FIG. 7 illustrates a configuration of a micromotor.
Figure 8:
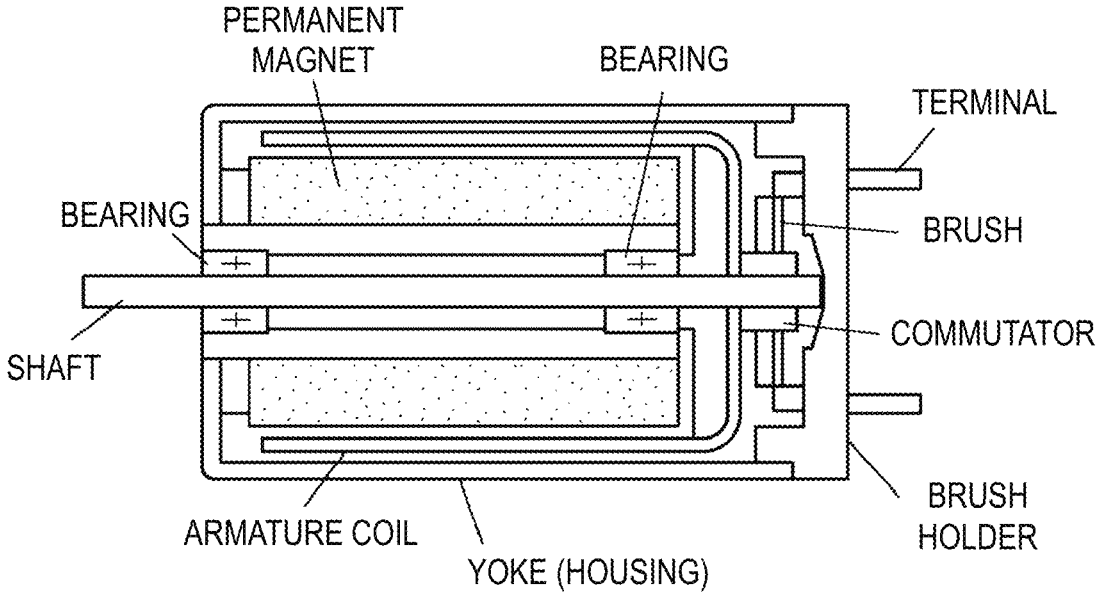
FIG. 8 illustrates a structure of a coreless motor.
Figure 8:
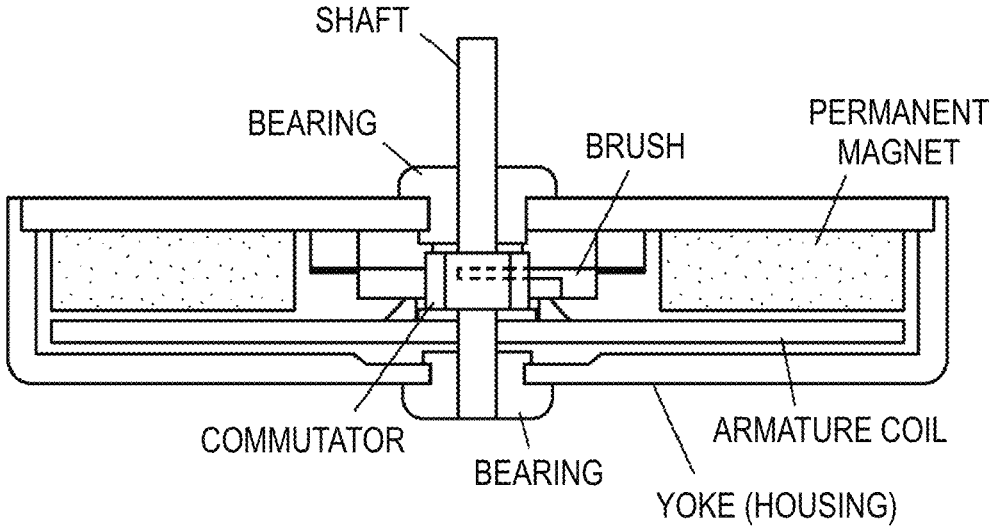

FIG. 4 shows some of results of structure observation performed for the test pieces. In these material structures, matrixes and dispersed particles were more minutely analyzed. FIG. 5 shows an enlarged picture illustrating analysis points (three points) in sample B2 (containing 1% of Ni+1% of Sn), and analysis results. In addition, FIG. 6 shows an enlarged picture illustrating analysis points (three points) in sample B5 (containing 1% of Ni+2% of In), and analysis results. In this embodiment, structure observation and measurement of the composition and the average particle size of dispersed particles were performed for each test piece. In this embodiment, the ratio $K_{Pd}/K_M$ was confirmed to fall within an appropriate range for all of measured composite dispersed particles in alloys of samples B1 to B8 and B10 to B12 in examples. In this embodiment, the average value of these ratios is calculated (Table 2).

On the other hand, in test materials (B13 and B14) which were not appropriate to conditions for the casting step, there were dispersed particles containing Pd and the additive element M, but there were not dispersed particles in which the value of $K_{Pd}/K_M$ fell within an appropriate range, and composite dispersed particles did not exist.

Next, a sliding test for evaluation of wear resistance was conducted for each test piece. Test conditions for the sliding test were the same as in the first embodiment. In addition, here values of wear depth with respect to two kinds of partner materials (AgCuNi-1 and AgCuNi-2) were measured. For the sliding contact materials produced in this embodiment, results of structure observation and results of the sliding test are shown in Table 2.

containing Pd and the additive element M, but the value of $K_{Pd}/K_M$ did not fall within an appropriate range. For the test material, only the particle size of dispersed particles was measured for reference. The particles had a large particle size, and wear resistance was insufficient.

As in the case of B13 and B14, suitable composite dispersed particles were not generated when casting conditions were not appropriate in alloy production. In the test material, the wear resistance improving effect was not exhibited even though Sn and In were added, and an alloy inferior in wear resistance to the AgPd alloy was produced. It was confirmed that for the material according to the present invention, not only composition control should be performed, but also material structures should be made suitable by securing appropriate casting conditions.

In addition, when consideration is also given to the results for AgPd (Ni, Co) alloys (A1 to A5) free from Sn and In in the first embodiment, the wear resistance improving effect of these alloys is not so high when the partner material is the AgCuNi alloy 2, but these alloys may be considerably effective for the AgCuNi alloy 1. Therefore, preferably, when applied to a brush, the sliding contact material according to the present invention is selected in consideration of

TABLE 2

| | Composition (% by mass) | | | | | | | Composite dispersed particles | | Wear area (μm2) | | | |
|---|---|---|---|---|---|---|---|---|---|---|---|---|---|
| | | | | | Additive element M | | | | Average particle | Partner material | | | |
| No. | Ag | Pd | Ni | Co | Sn | In | Sn + IN | $K_{Pd}/K_M$ | size | AgCuNi-1 | AgCnNi-2 | Evaluation*1 | Remarks |
| B1 | Balance | 30 | 1.0 | — | 0.5 | — | 0.5 | 3.52 | 0.5 μm | 1216 | 3358 | ⊙ | |
| B2 | | | | | 1.0 | | 1.0 | 3.54 | 0.8 μm | 1208 | 2908 | ⊙ | |
| B3 | | | | | 2.0 | | 2.0 | 3.37 | 1.3 μm | 2654 | 3099 | ○ | Dispersed particles coarsened (with a larger amount of Sn) |
| B4 | | | 1.0 | — | — | 1.0 | 1.0 | 3.22 | 0.6 μm | 1302 | 2758 | ⊙ | |
| B5 | | | | | | 2.0 | 2.0 | 3.28 | 0.9 μm | 1926 | 3496 | ⊙ | |
| B6 | | | | | | 3.0 | 3.0 | 3.15 | 1.7 μm | 2772 | 3446 | ○ | Dispersed particles coarsened (with a larger amount of In) |
| B7 | | | 1.0 | — | 0.5 | 1.0 | 1.5 | 3.58 | 0.7 μm | 1564 | 2413 | ⊙ | |
| B8 | | | | | 1.0 | 2.0 | 3.0 | 2.83 | 0.8 μm | 2315 | 3215 | ⊙ | |
| B9 | | | | | 2.0 | 2.0 | 4.0 | — | 2.4 μm*2 | 2722 | 3932 | x | Dispersed particles coarsened |
| B10 | | | — | 2.0 | 1.0 | — | 1.0 | 3.42 | 0.9 μm | 1698 | 2857 | ⊙ | |
| B11 | | | | 1.0 | — | 2.0 | 2.0 | 3.12 | 0.9 μm | 2012 | 2952 | ⊙ | |
| B12 | | 40 | 1.0 | — | 1.0 | 1.0 | 2.0 | 3.55 | 0.8 μm | 1148 | 2269 | ⊙ | |
| B13 | | 30 | 1.0 | — | 1.0 | — | 1.0 | — | 3.4 μm*2 | 6291 | 6840 | x | Casting temperature low |
| B14 | | | 1.0 | | 1.0 | | 1.0 | — | 5.2 μm*2 | 3890 | 4645 | x | Cooling rate low |
| A6 | | | — | — | — | — | — | — | — | 3188 | 5052 | x | Conventional art |

*1⊙ . . . Acceptable for both of two kinds of partner materials ○ . . . Acceptable for one of two kinds of partner materials x . . . Unacceptable for both of two kinds of partner materials

*2The composition of dispersed particles is out of range, but the value of particle size is described for reference.

It is apparent that by adding Sn and/or In to an AgPd (Ni, Co) alloy, an effect of further improving wear resistance is exhibited. The effect of improving wear resistance is remarkable particularly when AgCuNi-2, i.e. an improved material having high wear resistance, is applied as a partner material (commutator). Preferably, the concentration of Sn is 0.5% or more and 1.0% or less (B1 and B2), and the concentration of In is 1.0% by mass or more and 2.0% by mass or less (B4 and B5) as a composition that ensures excellent wear resistance in general. In the alloys having values above the appropriate value, dispersed particles were coarsened, and the wear area with respect to AgCuNi-1 exceeded the standard value. In addition, in the test material B9 which is an alloy containing Sn and In in a total amount of more than 3% by mass, there were dispersed particles the constituent material of a commutator as a partner material. When a commutator is formed from a conventional material such as the AgCuNi alloy 1, a contact structure with an AgPd (Ni, Co) alloy as a brush. Of course, for a material with Sn and In added to an AgPdNi alloy, it is not necessary that the material of a partner material be particularly limited.

INDUSTRIAL APPLICABILITY

As described above, the sliding contact material according to the present invention has higher wear resistance in comparison with a conventional Ag-based sliding contact material. The present invention is particularly useful as a sliding contact material for brushes of small motors, such as micromotors and coreless motors, which have a reduced size and increased rotation speed.

The invention claimed is:

1. A sliding contact material consisting of:

Pd in an amount of 20.0% by mass or more and 50.0% by mass or less;

Ni in an amount of 0.6% by mass or more and 3.0% by mass or less in terms of a total concentration;

an additive element M in an amount of 0.1% by mass or more and 3.0% by mass or less;

wherein the additive element M is Sn and/or In; and

Ag and inevitable impurities as a balance;

wherein the sliding contact material has material structures in which composite dispersed particles containing an intermetallic compound of Pd and the additive element M are dispersed in an Ag alloy matrix, and the ratio ($K_{Pd}/K_M$) of the content (% by mass) of Pd and the content (% by mass) of the additive element M in the composite dispersed particles is within a range of 2.4 or more and 3.6 or less.

2. The sliding contact material according to claim 1, wherein the average particle size of the composite dispersed particles is 1.0 μm or less.

3. The sliding contact material according to claim 2, wherein the sliding contact material contains at least Sn as the additive element M, and the content of Sn is 0.5% by mass or more and 1.0% by mass or less.

4. The sliding contact material according to claim 2, wherein the sliding contact material contains at least In as the additive element M, and the content of In is 1.0% by mass or more and 2.0% by mass or less.

5. The sliding contact material according to claim 2, wherein the sliding contact material contains both Sn and In as the additive element M, and the total content of Sn and In is 0.5% by mass or more and 3.0% by mass or less.

6. The sliding contact material according to claim 1, wherein the sliding contact material contains at least Sn as the additive element M, and the content of Sn is 0.5% by mass or more and 1.0% by mass or less.

7. The sliding contact material according to claim 6, wherein the sliding contact material contains at least In as the additive element M, and the content of In is 1.0% by mass or more and 2.0% by mass or less.

8. The sliding contact material according to claim 1, wherein the sliding contact material contains at least In as the additive element M, and the content of In is 1.0% by mass or more and 2.0% by mass or less.

9. The sliding contact material according to claim 1, wherein the sliding contact material contains both Sn and In as the additive element M, and the total content of Sn and In is 0.5% by mass or more and 3.0% by mass or less.

10. A motor in which the sliding contact material defined in claim 1 is applied to a brush.

11. A motor in which the sliding contact material defined in claim 2 is applied to a brush.

12. A motor in which the sliding contact material defined in claim 6 is applied to a brush.

13. A motor in which the sliding contact material defined in claim 8 is applied to a brush.

14. A method for producing the sliding contact material defined in claim 1, comprising a melting and casting step, the melting and casting step being a step of cooling a molten Ag alloy having a casting temperature, the molten Ag alloy consisting of Pd in an amount of 20.0% by mass or more and 50.0% by mass or less, Ni in an amount of 0.6% by mass or more and 3.0% by mass or less in terms of a total concentration, additive element M in an amount of 0.1% by mass or more and 3.0% by mass or less, and Ag and inevitable impurities as a balance, the casting temperature being set to a temperature higher by 100° C. or more than a liquidus temperature of an AgPd binary alloy having a Pd concentration equal to the Pd concentration of the Ag alloy, the molten Ag alloy being cooled at a cooling rate of 100° C./min or more.

15. A method for producing the sliding contact material defined in claim 2, comprising a melting and casting step, the melting and casting step being a step of cooling a molten Ag alloy having a casting temperature, the molten Ag alloy consisting of Pd in an amount of 20.0% by mass or more and 50.0% by mass or less, Ni in an amount of 0.6% by mass or more and 3.0% by mass or less in terms of a total concentration, additive element M in an amount of 0.1% by mass or more and 3.0% by mass or less, and Ag and inevitable impurities as a balance, the casting temperature being set to a temperature higher by 100° C. or more than a liquidus temperature of an AgPd binary alloy having a Pd concentration equal to the Pd concentration of the Ag alloy, the molten Ag alloy being cooled at a cooling rate of 100° C./min or more.

16. A method for producing the sliding contact material defined in claim 6, comprising a melting and casting step, the melting and casting step being a step of cooling a molten Ag alloy having a casting temperature, the molten Ag alloy consisting of Pd in an amount of 20.0% by mass or more and 50.0% by mass or less, Ni in an amount of 0.6% by mass or more and 3.0% by mass or less in terms of a total concentration, additive element M in an amount of 0.1% by mass or more and 3.0% by mass or less, and Ag and inevitable impurities as a balance, the casting temperature being set to a temperature higher by 100° C. or more than a liquidus temperature of an AgPd binary alloy having a Pd concentration equal to the Pd concentration of the Ag alloy, the molten Ag alloy being cooled at a cooling rate of 100° C./min or more.

17. A method for producing the sliding contact material defined in claim 8, comprising a melting and casting step, the melting and casting step being a step of cooling a molten Ag alloy having a casting temperature, the molten Ag alloy consisting of Pd in an amount of 20.0% by mass or more and 50.0% by mass or less, Ni in an amount of 0.6% by mass or more and 3.0% by mass or less in terms of a total concentration, additive element M in an amount of 0.1% by mass or more and 3.0% by mass or less, and Ag and inevitable impurities as a balance, the casting temperature being set to a temperature higher by 100° C. or more than a liquidus temperature of an AgPd binary alloy having a Pd concentration equal to the Pd concentration of the Ag alloy, the molten Ag alloy being cooled at a cooling rate of 100° C./min or more.

18. A method for producing the sliding contact material defined in claim 9, comprising a melting and casting step, the melting and casting step being a step of cooling a molten Ag alloy having a casting temperature, the molten Ag alloy consisting of Pd in an amount of 20.0% by mass or more and 50.0% by mass or less, Ni in an amount of 0.6% by mass or more and 3.0% by mass or less in terms of a total concentration, additive element M in an amount of 0.1% by mass or more and 3.0% by mass or less, and Ag and inevitable impurities as a balance, the casting temperature being set to a temperature higher by 100° C. or more than a liquidus temperature of an AgPd binary alloy having a Pd concentration equal to the Pd concentration of the Ag alloy, the molten Ag alloy being cooled at a cooling rate of 100° C./min or more.

* * * * *